US011328860B2

(12) United States Patent
Someya et al.

(10) Patent No.: US 11,328,860 B2
(45) Date of Patent: May 10, 2022

(54) COIL COMPONENT

(71) Applicant: TDK CORPORATION, Tokyo (JP)

(72) Inventors: Shuhei Someya, Tokyo (JP); Tasuku Mikogami, Tokyo (JP); Yuichi Anzai, Tokyo (JP); Hideomi Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 457 days.

(21) Appl. No.: 16/394,250

(22) Filed: Apr. 25, 2019

(65) Prior Publication Data

US 2019/0333690 A1 Oct. 31, 2019

(30) Foreign Application Priority Data

Apr. 25, 2018 (JP) ..... JP2018-084255
Apr. 4, 2019 (JP) ..... JP2019-072030

(51) Int. Cl.

*H01F 27/24* (2006.01)
*H01F 27/34* (2006.01)
*H01F 27/06* (2006.01)
*H01F 27/28* (2006.01)

(52) U.S. Cl.

CPC ..... *H01F 27/34* (2013.01); *H01F 27/06* (2013.01); *H01F 27/24* (2013.01); *H01F 27/2823* (2013.01)

(58) Field of Classification Search

CPC ..... H01F 27/34; H01F 27/06; H01F 27/24; H01F 27/2823; H01F 2017/0093; H01F 2017/046; H01F 27/2828; H01F 27/292; H01F 3/10; H01F 17/045; H01F 27/306

See application file for complete search history.

(56) References Cited

U.S. PATENT DOCUMENTS

2003/0218527 A1* 11/2003 Okamoto ..... H01F 27/027 336/208
2009/0071454 A1* 3/2009 Fujiyama ..... H01F 38/12 123/621
2012/0133470 A1* 5/2012 Fujiyama ..... H01F 38/12 336/192
2013/0120100 A1* 5/2013 Muramatsu ..... H01F 38/14 336/221
2016/0086725 A1* 3/2016 Igarashi ..... H01F 17/045 336/83
2016/0307699 A1 10/2016 Aaron et al.

FOREIGN PATENT DOCUMENTS

JP 2004207405 A * 7/2004
WO WO-2013018755 A1 * 2/2013 ..... H01F 17/04
WO 2015005129 A1 1/2015

* cited by examiner

*Primary Examiner* — Mang Tin Bik Lian
(74) *Attorney, Agent, or Firm* — Young Law Firm, P.C.

(57) ABSTRACT

Disclosed herein is a coil component that includes: a first core having a mounting surface and a coil placing surface positioned opposite to the mounting surface; a lower coil placed on the coil placing surface such that a coil axis of the lower coil extends substantially perpendicular to the coil placing surface; an upper coil substantially coaxially stacked on the lower coil; and a second core disposed through inner diameter areas of the lower and upper coils. The number of turns of one of the lower and upper coils is larger by less than one turn than other one of the lower and upper coils. The diameter of the second core is larger at a first section surrounded by the other one of the lower and upper coils than at a second section surrounded by the one of the lower and upper coils.

3 Claims, 6 Drawing Sheets

COIL COMPONENT

BACKGROUND OF THE INVENTION

Field of the Invention

The present invention relates to a coil component and, more particularly, to a coil component having a structure in which a lower coil and an upper coil are stacked one on the other and disposed on a core having a mounting surface.

Description of Related Art

While a common mode filter is used generally for removing common mode noise superimposed on a differential signal line, it is sometimes inserted into a power supply line. In a common mode filter for power supply, a large amount of current flows in a coil, so that a coil formed by winding a wire having a large sectional area, such as a flat-type wire is used in the power supply common mode filter. For example, International Publication WO 2015/005129 discloses a power supply common mode filter having a structure in which two coils each obtained by winding a flat-type wire are stacked one on the other and disposed on a core.

However, in the coil component described in International Publication WO 2015/005129, the winding start and end positions of the lower coil almost coincide in position with each other; on the other hand, the winding start and end positions of the upper coil differ from each other. This causes a difference of less than one turn between the number of turns of the lower coil and that of the upper coil. The difference in the number of turns causes a difference in inductance, which may result in loss of characteristic balance between the lines.

SUMMARY

It is therefore an object of the present invention to reduce a difference in an inductance between the lower coil and the upper coil in a coil component having a structure in which the lower coil and the upper coil are stacked one on the other and disposed on a core having a mounting surface.

A coil component according to the present invention includes: a first core having a mounting surface and a coil placing surface positioned opposite to the mounting surface; a lower coil placed on the coil placing surface such that a coil axis of the lower coil extends substantially perpendicular to the coil placing surface, the lower coil having one end drawn to a first area of the mounting surface and other end drawn to a second area of the mounting surface; an upper coil substantially coaxially stacked on the lower coil, the upper coil having one end drawn to a third area of the mounting surface and other end drawn to a fourth area of the mounting surface; and a second core disposed through inner diameter areas of the lower and upper coils. The number of turns of one of the lower and upper coils is larger by less than one turn than other one of the lower and upper coils. The diameter of the second core is larger at a first section surrounded by the other one of the lower and upper coils than at a second section surrounded by the one of the lower and upper coils.

According to the present invention, the diameter of the second core is increased at a part thereof corresponding to the coil having a smaller number of turns, thus enhancing the inductance of the coil having a smaller number of turns. This can reduce a difference in inductance between the lower and upper coils caused due to a difference in the number of turns.

In the present invention, the first and second areas may be arranged in a first direction perpendicular to the coil axis, the third and fourth areas may be arranged in the first direction, the first and third areas may be arranged in a second direction perpendicular to the coil axis and first direction, and the second and fourth areas may be arranged in the second direction. A winding direction from one end of the lower coil to the other end thereof as viewed in the coil axis direction and a winding direction from one end of the upper coil to the other end thereof as viewed in the coil axis direction may be the same as each other. With this configuration, the coil component of the present invention can be suitably used as a common mode filter.

In the present invention, the number of turns of the lower coil may be larger by less than one turn than the number of turns of the upper coil. With this configuration, a difference between the line lengths of the lower and upper coils caused due to a difference in distance from the mounting surface is reduced, making it possible to reduce a difference in DC resistance between the lower and upper coils.

As described above, according to the present invention, in the coil component having a structure in which the lower and upper coils are stacked one on the other and disposed on the core having the mounting surface, a difference in an inductance between the lower and upper coils can be reduced.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
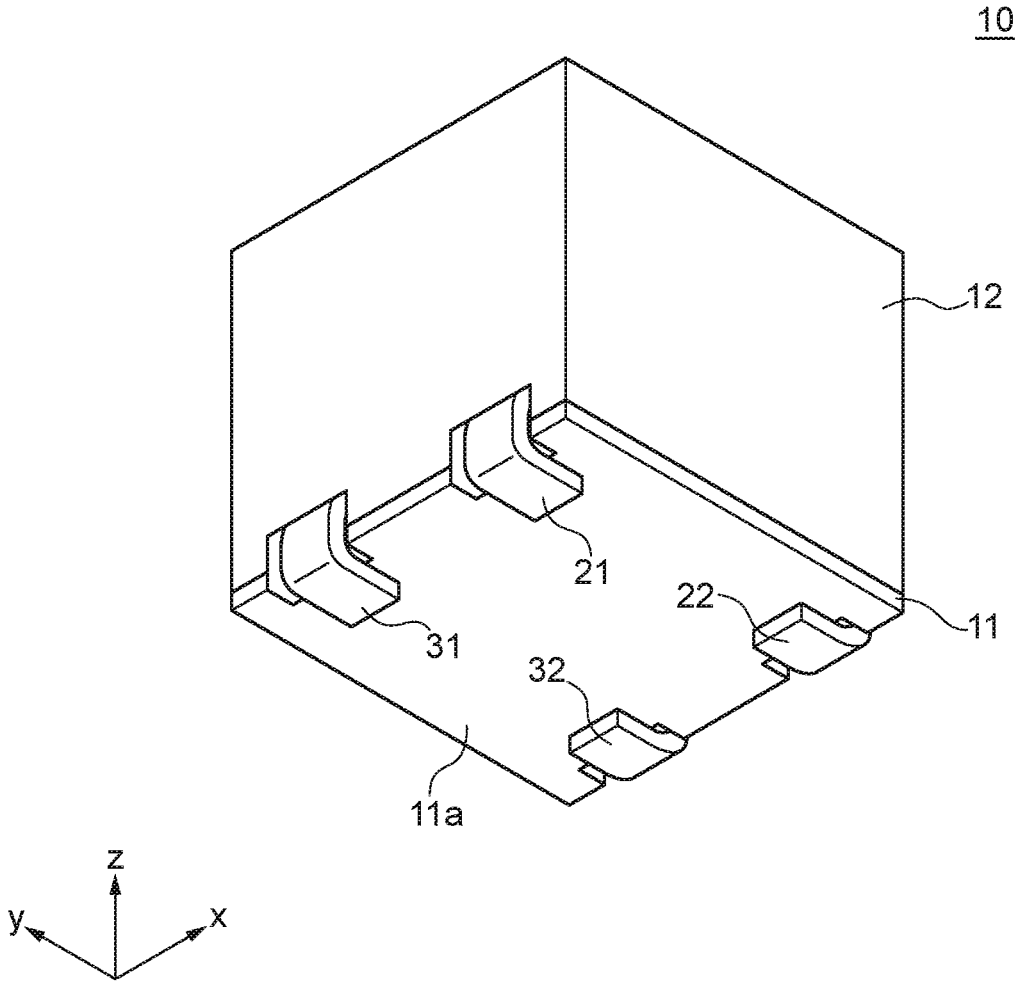
FIG. 1 is a schematic perspective view illustrating the outer structure of a coil component according to a preferred embodiment of the present invention.
Figure 2:
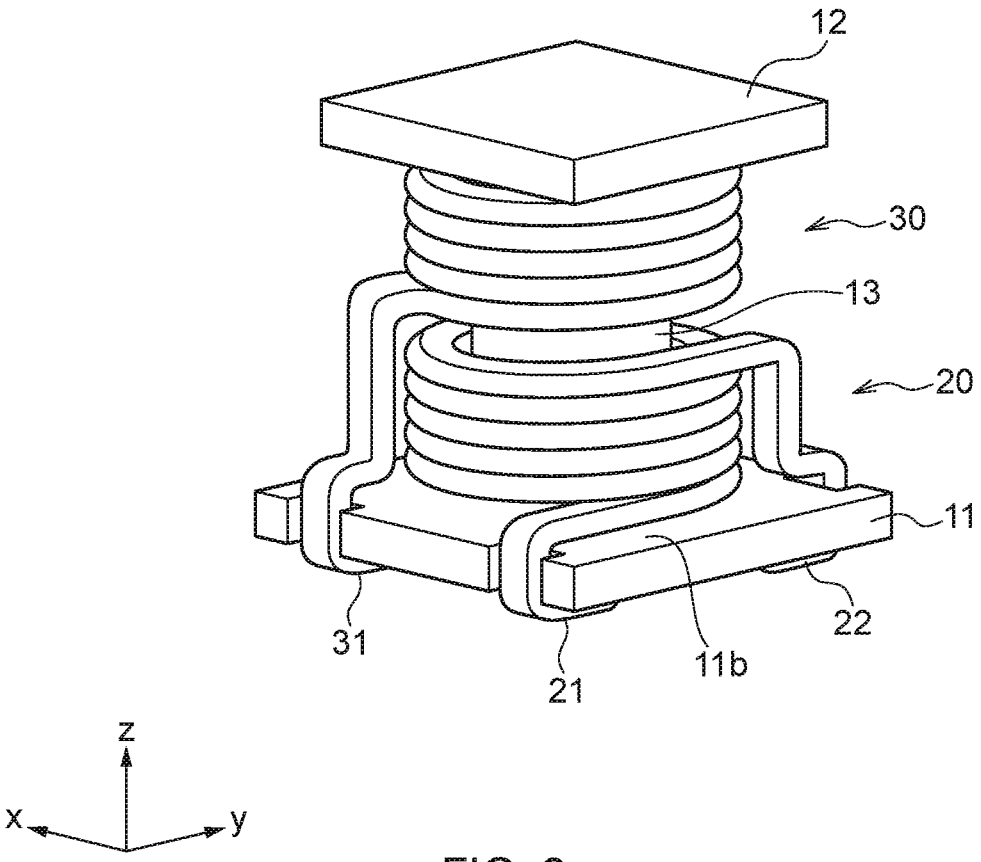
FIG. 2 is a view for explaining the inner structure of the coil component according to the preferred embodiment of the present invention.

FIG. 1 is a schematic perspective view illustrating the outer structure of a coil component 10 according to a preferred embodiment of the present invention. FIG. 2 is a view for explaining the inner structure of the coil component 10 according to the present embodiment.

As illustrated in FIGS. 1 and 2, the coil component 10 according to the present embodiment includes a plate-like core 11 having a mounting surface 11*a*, a lower coil 20 and an upper coil 30 which are disposed on a coil placing surface 11*b* of the core 11, a box-like core 12 covering the lower and upper coils 20 and 30, and a rod-like core disposed through the inner diameter parts of the respective lower and upper coils 20 and 30. In FIG. 2, all the side surfaces (xz- and yz-planes) of the box-like core 12 are omitted so as to make the lower and upper coils 20 and 30 visible. Although all the side surfaces (xz- and yz-planes) are constituted by the core 12 in the example of FIG. 1, some or all of the side surfaces may be constituted by the core 11. The rod-like core 13 may be a member separately formed from the cores 11 and 12 or a member integrally formed with one of the cores 11 and 12.

The mounting surface 11*a* constitutes the xy-plane, and end parts 21, 22 of the lower coil 20 and end parts 31, 32 of the upper coil 30 are disposed at mutually different areas (first to fourth areas) of the mounting surface 11*a*. The mounting surface 11*a* faces a circuit board in a mounted state. When the coil component 10 according to the present embodiment is mounted on the circuit board, a land pattern on the circuit board and the end parts 21, 22, 31, and 33 are connected through solders. The end parts 21 and 22 are arranged in the y-direction, the end parts 31 and 32 are arranged in the y-direction, the end parts 21 and 31 are arranged in the x-direction, and the end parts 22 and are arranged in the x-direction. Although, in the present embodiment, the end parts 21 and 31 are provided along the same side extending in the x-direction, and the end parts 22 and 32 are provided along the same side extending in the x-direction, the present invention is not limited to this. For example, the end parts 21 and 22 may be provided along the same side extending in the y-direction, and the end parts 31 and 32 are provided along the same side extending in the y-direction.

As illustrated in FIG. 2, the coil axes of both the lower and upper coils 20 and 30 extend in the z-direction, and the lower and upper coils 20 and 30 are coaxially stacked one on the other in this order and disposed on the coil placing surface 11*b*. In the present embodiment, the lower and upper coils 20 and 30 are constituted by flat-type wires, and the end portions thereof are bent so as to dispose the four end parts 21, 22, 31, and 32 at mutually different areas of the mounting surface 11*a*.

Figure 3A:
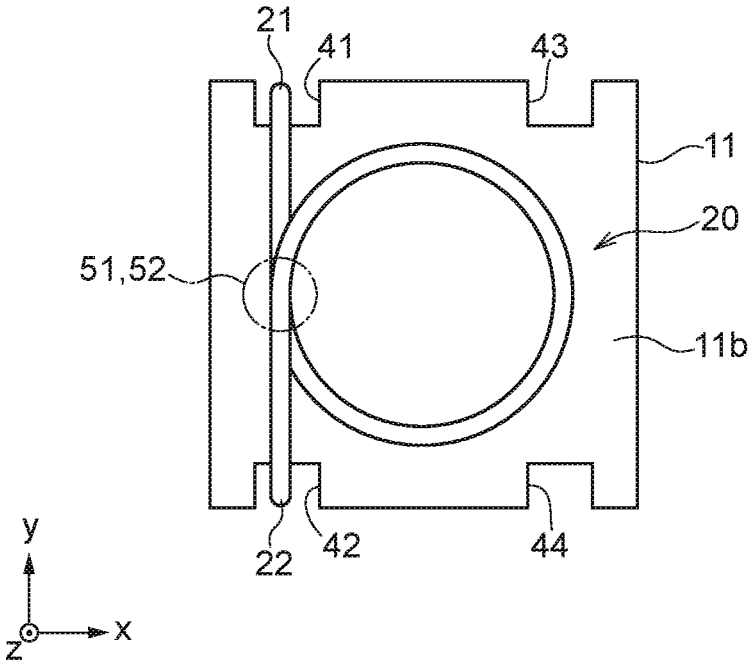
FIG. 3A is a plan view of a lower coil.
Figure 3B:
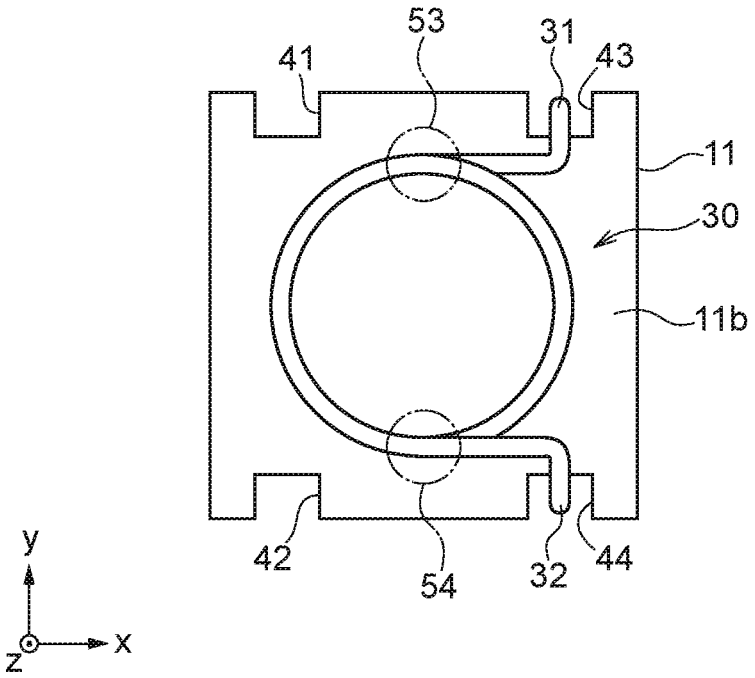
FIG. 3B is a plan view of an upper coil.

FIG. 3A is a plan view of the lower coil 20, and FIG. 3B is a plan view of the upper coil 30.

As illustrated in FIG. 3A, the end parts 21 and 22 of the lower coil 20 are bent to the mounting surface 11*a* side through cuts 41 and 42 formed in the core 11, and the winding direction from the end part 21 toward the end part 22 is counterclockwise (left-handed) as viewed in the z-direction. Similarly, as illustrated in FIG. 3B, the end parts 31 and 32 of the upper coil 30 are bent to the mounting surface 11*a* side through cuts 43 and 44 formed in the core 11, and the winding direction from the end part 31 toward the end part 32 is counterclockwise (left-handed) as viewed in the z-direction. Therefore, when the coil component 10 is used, e.g., as a common mode filter that uses the end parts 21 and 31 as a pair of input side terminals and the end parts 22 and 32 as a pair of output side terminals, the polarities of the input and output side differential signal lines are not reversed.

Further, as illustrated in FIG. 3A, in the lower coil 20, a winding start position 51 and a winding end position 52 of the wire extending from the end part 21 side almost coincide in position with each other; on the other hand, as illustrated in FIG. 3B, in the upper coil 30, a winding start position 53 and a winding end position 54 of the wire extending from the end part 31 side are shifted in position from each other by 0.5 turns. This means that it is difficult to make the number of turns of the lower coil 20 and that of the upper coil 30 completely coincide with each other, and a difference of less than one turn occurs between the lower and upper coils 20 and 30.

Figure 4:
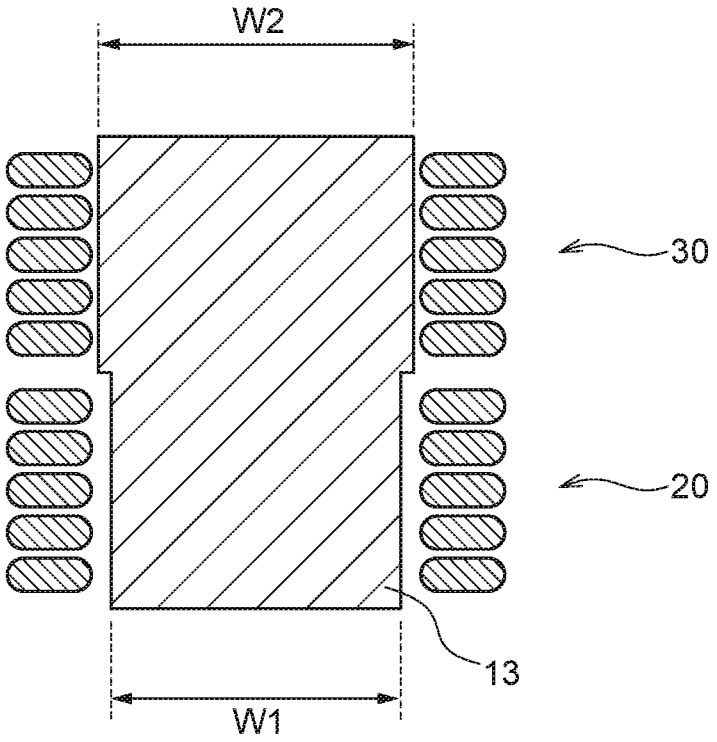
FIG. 4 is a partial cross-sectional view of the coil component according to the preferred embodiment of the present invention.

When the configuration in which the number of turns is increased by less than one turn is assigned to the lower coil 20, the inductance of the upper coil 30 becomes smaller than that of the lower coil 20 due to the slight difference in the number of turns. In order to reduce the difference in inductance, in the present embodiment, as illustrated in FIG. 4, which is a cross-sectional view of the coil component 10, a diameter W2 of a part of the rod-like core 13 that is positioned in the inner diameter part of the upper coil 30 having a smaller number of turns is made larger than a diameter W1 of a part of the rod-like core 13 that is positioned in the inner diameter part of the lower coil 20 having a larger number of turns. With this configuration, inductance per turn is larger in the upper coil 30 than in the lower coil 20, making it possible to reduce the difference in inductance caused due to the difference in the number of turns.

Figure 5:
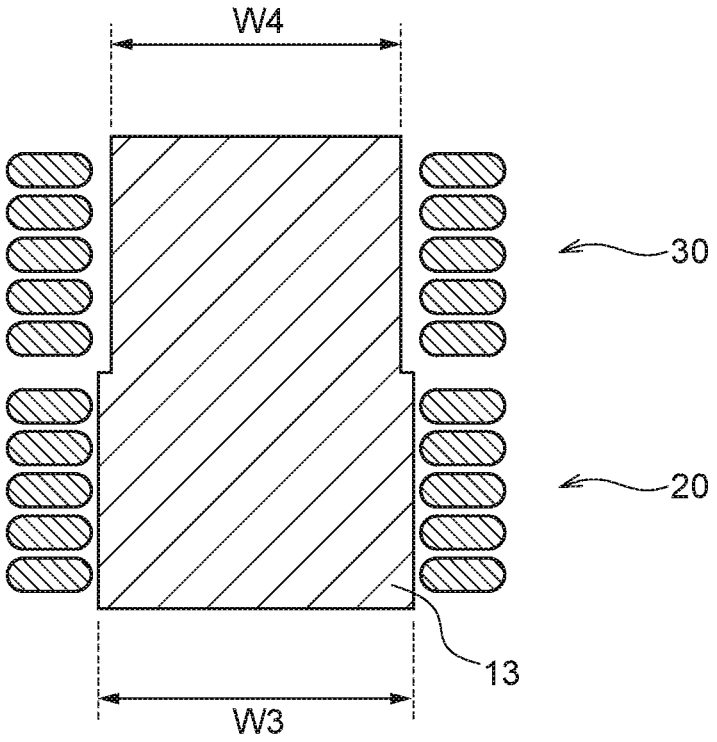
FIG. 5 is a partial cross-sectional view of the coil component according to a modification.

Conversely, when the configuration in which the number of turns is increased by less than one turn is assigned to the upper coil 30, the inductance of the upper coil 30 becomes larger than that of the lower coil 20 due to the slight difference in the number of turns. In this case, as illustrated in FIG. 5, which is a cross-sectional view of the coil component 10, a diameter W4 of a part of the rod-like core 13 that is positioned in the inner diameter part of the upper coil 30 having a larger number of turns is made smaller than a diameter W3 of a part of the rod-like core 13 that is positioned in the inner diameter part of the lower coil 20 having a smaller number of turns. With this configuration, inductance per turn is smaller in the upper coil 30 than in the lower coil 20, making it possible to reduce the difference in inductance caused due to the difference in the number of turns.

Further, it is possible to reduce the difference between the line lengths of the lower and upper coils 20 and 30 by assigning the configuration in which the number of turns is increased by less than one turn to the lower coil 20. This arrangement is made considering that the line length of the upper coil 30 becomes larger than that of the lower coil 20 because the upper coil 30 is more distant from the mounting surface 11*a*. That is, by assigning the configuration in which the number of turns is increased by less than one turn to the lower coil 20, the difference in the line length can be reduced.

Figure 6A:
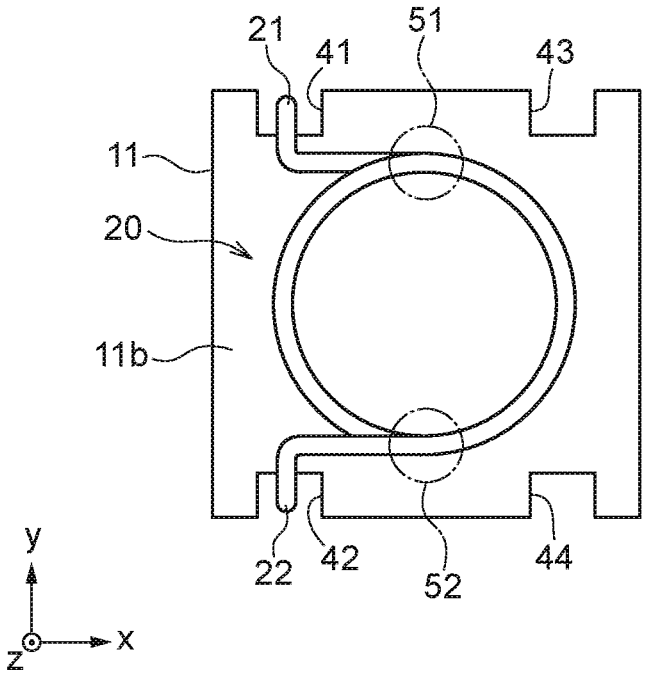
FIG. 6A is a plan view of a lower coil according to the modification.
Figure 6B:
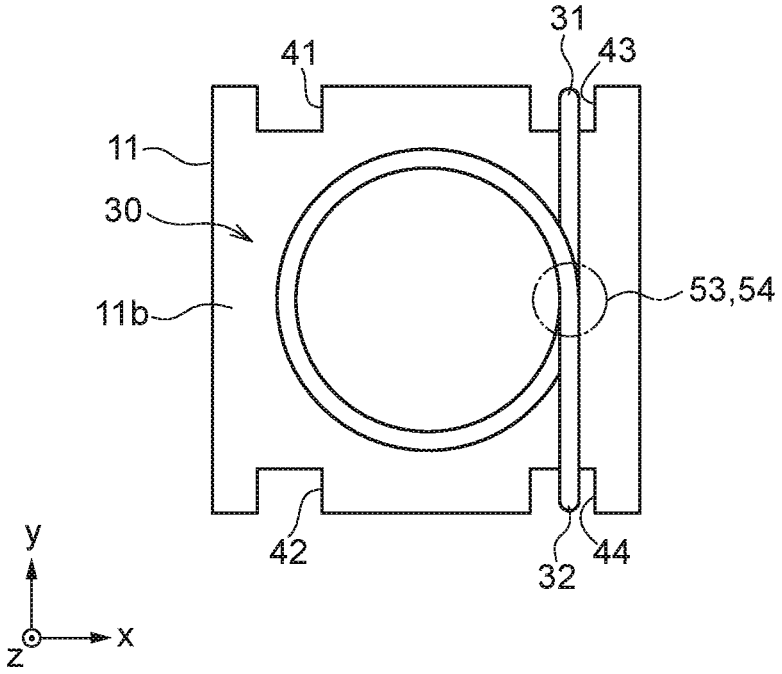
FIG. 6B is a plan view of an upper coil according to the modification.

Further, in the example illustrated in FIG. FIG. 3A, in the lower coil 20, a winding start position 51 and a winding end position 52 of the wire extending from the end part 21 side almost coincide in position with each other; on the other hand, as illustrated in FIG. 3B, in the upper coil 30, a winding start position 53 and a winding end position 54 of the wire extending from the end part 31 side are shifted in position from each other by 0.5 turns. However, the winding modes of the lower and upper coils 20 and 30 may be reversed. That is, as illustrated in FIGS. 6A and 6B, in the lower coil 20, the winding start position 51 and winding end position 52 of the wire extending from the end part 21 side may be shifted in position from each other by 0.5 turns, while in the upper coil 30, the winding start position 53 and winding end position 54 of the wire extending from the end part 31 side may almost coincide in position with each other.

In either case, a difference of less than one turn occurs between the number of turns of the lower coil 20 and that of the upper coil 30 as long as the winding directions of the lower and upper coils 20 and 30 are the same, and the end parts 21, 22, 31, and 32 are laid out so as not to allow polarity reversal. Thus, as illustrated in FIGS. 4 and 5, by making the diameter of a part of the core 13 corresponding to the coil having a smaller number of turns larger (by making the diameter of a part of the core 13 corresponding to the coil having a larger number of turns smaller), a difference in inductance can be reduced.

It is apparent that the present invention is not limited to the above embodiments, but may be modified and changed without departing from the scope and spirit of the invention.

What is claimed is:

1. A coil component comprising:

a first core having a mounting surface and a coil placing surface positioned opposite to the mounting surface;

a lower coil placed on the coil placing surface such that a coil axis of the lower coil extends substantially perpendicular to the coil placing surface, the lower coil having one end drawn to a first area of the mounting surface and other end drawn to a second area of the mounting surface;

an upper coil substantially coaxially stacked on the lower coil, the upper coil having one end drawn to a third area of the mounting surface and other end drawn to a fourth area of the mounting surface; and a second core disposed through inner diameter areas of the lower and upper coils, wherein a number of turns of the lower coil is larger by less than one turn than a number of turns of the upper coil, and wherein a diameter of the second core is larger at a first section surrounded by the upper coil than at a second section surrounded by the lower coil.

2. The coil component as claimed in claim 1, wherein the first and second areas are arranged in a first direction substantially perpendicular to the coil axis, wherein the third and fourth areas are arranged in the first direction, wherein the first and third areas are arranged in a second direction substantially perpendicular to the coil axis and first direction, wherein the second and fourth areas are arranged in the second direction, and wherein a winding direction from the one end of the lower coil to the other end of the lower coil as viewed in a coil axis direction is the same as a winding direction from the one end of the upper coil to the other end of the upper coil as viewed in the coil axis direction.

3. A coil component comprising:

a magnetic core having first and second sections arranged in a first direction;

a first coil wound around the first section of the magnetic core; and a second coil wound around the second section of the magnetic core, and another magnetic core arranged such that the first section of the magnetic core is located between the second section of the magnetic core and the another magnetic core, wherein both ends of the first and second coils are fixed to the another magnetic core, wherein a diameter of the first section is smaller than a diameter of the second section, and wherein a number of turn of the first coil is greater than a number of turns of the second coil.

* * * * *